US005394140A

United States Patent [19]

Wong et al.

[11] Patent Number: 5,394,140

[45] Date of Patent: Feb. 28, 1995

[54] METHOD AND APPARATUS FOR PRE-PROGRAMMED CALL-BACK-NUMBER-DETERMINED ALERT

[75] Inventors: Poh-T'in Wong, Boynton Beach; Allen J. Weidler, Lake Worth; William J. Burke, Boca Raton, all of Fla.

[73] Assignee: Motorola, Inc., Schaumburg, Ill.

[21] Appl. No.: 980,047

[22] Filed: Nov. 23, 1992

[51] Int. Cl.[6] ..... G08B 5/22

[52] U.S. Cl. ..... 340/825.44; 340/825.22

[58] Field of Search ..... 340/825.44, 825.45, 340/825.46, 825.48, 311.1, 825.22; 364/705.05, 715.11; 455/38.1, 38.2, 38.5

[56] References Cited

U.S. PATENT DOCUMENTS

| | | | |
|---|---|---|---|
| H1,173 | 4/1993 | Davis et al. | 340/825.44 |
| 4,758,834 | 7/1988 | Sato et al. . | |
| 4,868,561 | 9/1989 | Davis . | |
| 4,922,221 | 5/1990 | Sato et al. . | |
| 4,994,797 | 2/1991 | Breeden . | |
| 5,043,721 | 8/1991 | May | 364/705.05 |
| 5,122,778 | 6/1992 | Erhart et al. | 364/715.11 |

*Primary Examiner*—Michael Horabik
*Attorney, Agent, or Firm*—R. Louis Breeden

[57] ABSTRACT

A method and apparatus in a communication receiver (110) for controlling an alert in response to a received call-back number (233) include receiving (402) the call-back number (233). A processor (208) in the communication receiver (110) compares (406) the received call-back number (233) with a list of pre-programmed call-back numbers (226, 228, 230) stored in a memory (210). If the received call-back number (233) matches (408) one of the pre-programmed call-back numbers (226, 228, 230), the processor (208) selects (410) a pre-programmed alert (236, 238, 240) corresponding to the matched pre-programmed call-back number (233), and instructs (414) an alert generator (212) to generate the selected pre-programmed alert (236, 238, 240).

20 Claims, 6 Drawing Sheets

FIG. 1
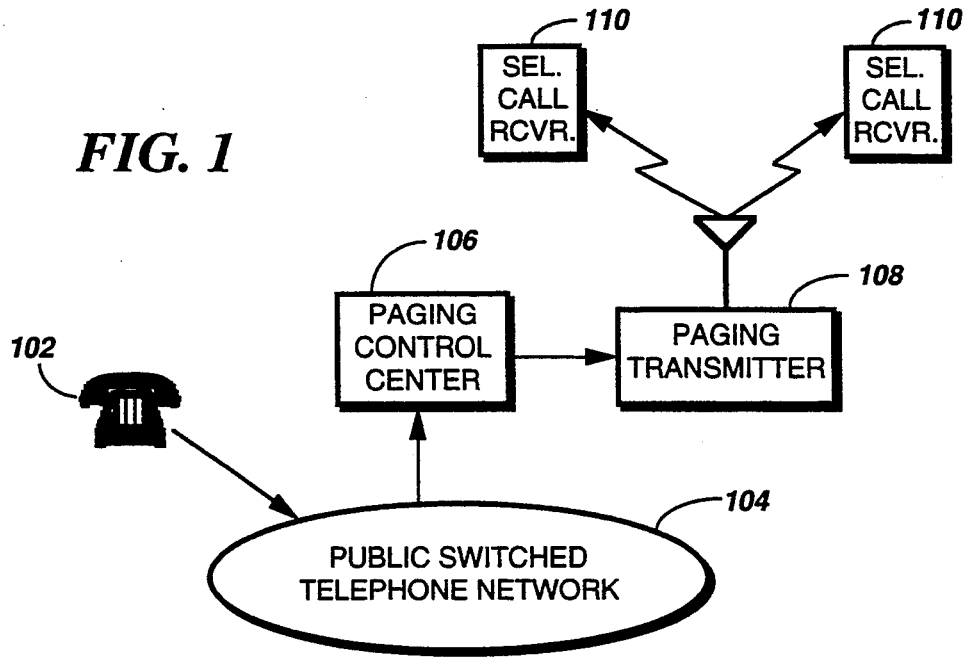
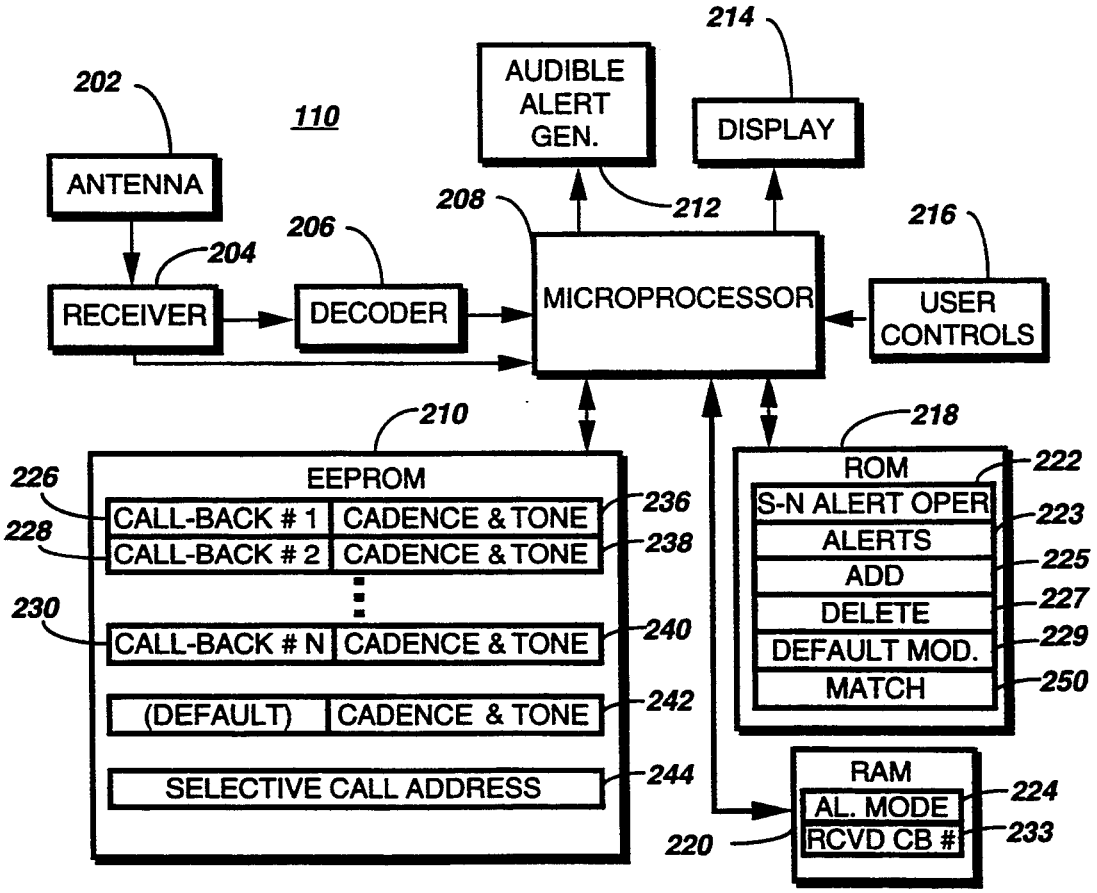
FIG. 2

METHOD AND APPARATUS FOR PRE-PROGRAMMED CALL-BACK-NUMBER-DETERMINED ALERT

FIELD OF THE INVENTION

This invention relates in general to communication receivers, and more specifically to a method and apparatus in a communication receiver for generating a pre-programmed special alert in response to receiving a call-back number that matches a pre-programmed number.

BACKGROUND OF THE INVENTION

Radio pagers (also known as selective call receivers) having a plurality of alerts are well known. It was common before numeric display pagers became available for a radio pager to have a plurality of predetermined selective call addresses, each associated with a telephone access number that could be dialed by callers to send pages to the associated selective call address. Typically, an indication, e.g., a unique alert tone or alert cadence, was generated in response to receiving a page directed to the selective call address. By partitioning potential callers into several different groups, each given a different telephone access number to call, a user could attain some degree of knowledge of the source of the call. For example, a user could give a first telephone access number to business associates, a second number to friends, a third number to relatives, etc. By noting the unique alert accompanying a page, a user was able to discern which telephone access number was dialed to send the page, and thus which of the groups of callers probably originated the page. A significant drawback to this approach of call source identification is that assigning multiple telephone access numbers to a pager is expensive. Another drawback resulted from the limited number of unique addresses and corresponding telephone access numbers possible for each pager.

The arrival of the numeric display pager significantly reduced the need to partition callers into separate groups dialing separate telephone access numbers. By utilizing numeric display paging, callers could dial a single telephone access number to send a call-back number (entered by the caller using, for example, a tone dialing telephone set) that the page recipient could then call to contact the caller by telephone. In many instances the page recipient could discern the identity of a familiar caller by recognizing a familiar call-back number, e.g., the number of the page recipient's home or office, or that of an important client. This ability largely eliminated the need for the expensive multiple telephone access number approach of source identification.

Still, there are situations that can impair one's ability to discern the identity of even an important caller from a displayed call-back number. For example, the call-back number might be that of a relatively new business associate and not yet committed to the page recipient's memory, or perhaps the display might be poorly lighted, making it difficult to read.

Thus, what is needed is a way to aid a user in discerning that a call is from a predetermined subset of important callers without the user's having to memorize call-back numbers or having to read a poorly lighted displayed number. A way is needed that does not require expensive multiple telephone access numbers for a single pager.

SUMMARY OF THE INVENTION

An aspect of the present invention is a communication receiver comprising a receiver element for receiving a message comprising at least a received call-back number, and a storage element for storing at least one user-programmed call-back number along with data defining at least one corresponding user-programmed special audible alert, and further for storing data defining a user-programmed default audible alert. The communication receiver further comprises a processor coupled to the receiver element for processing the message to derive the received call-back number and coupled to the storage element for comparing the received call-back number with the at least one user-programmed call-back number. The communication receiver also includes an audible alert generation element coupled to the processor for generating, in response to the received call-back number being found equal to a call-back number included in the at least one user-programmed call-back number, the corresponding user-programmed special audible alert in accordance with the data defining said alert. The processor comprises a first processor element for controlling the audible alert generation element to generate the user-programmed default audible alert in response to the received call-back number being found not equal to any call-back number included in the at least one user-programmed call back number.

Another aspect of the present invention is a selective call receiver comprising a receiver for receiving information comprising an address and a message containing at least a received call-back number, and a decoder coupled to the receiver for decoding the received address. The selective call receiver further comprises a memory element for storing at least one user-programmed call-back number and data defining at least one corresponding user-programmed special audible alert, and further for storing data defining a user-programmed default audible alert. The selective call receiver also includes a processor responsive to the decoder and coupled to the receiver for processing the received message to derive the received call-back number, the processor also coupled to the memory element for comparing the received call-back number with the at least one user-programmed call-back number. In addition, the selective call receiver includes a display coupled to the processor for displaying the received message, and an audible alert generator coupled to the processor for generating, in response to the received call-back number being found equal to a call-back number included in the at least one user-programmed call-back number, the corresponding user-programmed special audible alert in accordance with the data defining the alert. The processor comprises a first processor element for controlling the audible alert generator to generate the user-programmed default audible alert in response to the received call-back number being found not equal to any call-back number included in the at least one user-programmed call back number.

Another aspect of the present invention is a method in a communication receiver for controlling an audible alert in response to a received call-back number, the method comprising the steps of (a) receiving a message comprising at least the received call-back number, and (b) comparing the received call-back number with at least one user-programmed call-back number. The method further comprises the steps of (c) selecting a user-programmed special audible alert corresponding to the received call-back number in response to determining in step (b) that the received call-back number is equal to a call-back number included in the at least one user-programmed call-back number, and (d) selecting a user-programmed default audible alert in response to determining in step (b) that the received call-back number is not equal to any call-back number included in the at least one user-programmed call-back number. The method further comprises the step of (e) generating the user-programmed audible alert selected in accordance with steps (c) and (d).

BRIEF DESCRIPTION OF THE DRAWINGS

FIG. 1 is an electrical block diagram of a communication system in accordance with the preferred embodiment of the present invention.

FIG. 2 is an electrical block diagram of a selective call receiver in accordance with the preferred embodiment of the present invention.

DESCRIPTION OF THE PREFERRED EMBODIMENT

Figure 3:
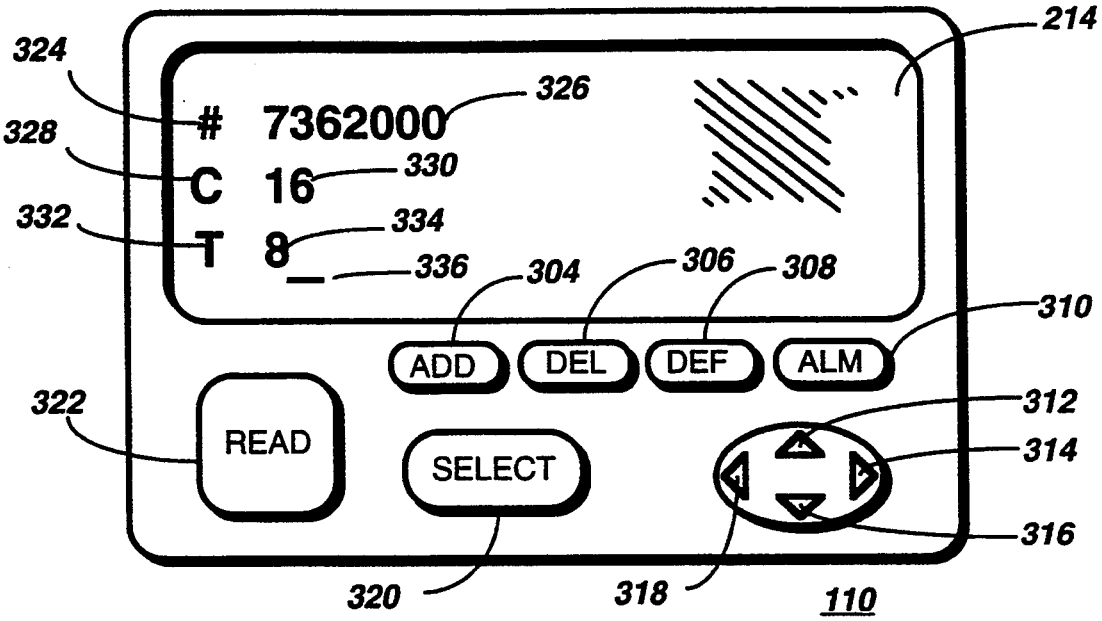
FIG. 3 is an orthographic front view of a selective call receiver in accordance with the preferred embodiment of the present invention.

Referring to FIG. 1, an electrical block diagram of a communication system in accordance with the preferred embodiment of the present invention depicts a telephone 102 coupled through the Public Switched Telephone Network (PSTN) 104 to a paging control center 106. The paging control center 106 is coupled to a paging transmitter 108, which transmits selective call messages by radio signals to a selective call receiver 110 preferably having display capability for displaying a call-back number. In operation, a caller desiring to contact a user of a selective call receiver 110 uses the telephone 102 to place a call through the PSTN 104 by dialing a paging access number assigned to an address of the selective call receiver 110. Upon receiving the call, the paging control center 106 prompts the caller to enter a call-back number using tone dialing buttons of the telephone 102, after which the paging control center 106 sends the address of the called selective call receiver 110 and the call-back number to the paging transmitter 108. In response, the paging transmitter 108 transmits over the air the address along with the call-back number, preferably using a standard radio paging protocol such as the Post Office Code Standardization Advisory Group (POCSAG) protocol, although it will be appreciated that other signaling protocols can be utilized as well.

After receiving the address and upon recognizing that the address matches an address of the selective call receiver 110, the selective call receiver 110 generates an alert, and then in response to an action by a user of the selective call receiver 110, e.g., a button push, displays the call-back number. The user then finds a telephone and places a call to the call-back number to converse with the caller. Additionally, in accordance with the preferred embodiment of the present invention, upon receipt of the call-back number the selective call receiver 110 accesses a list of pre-programmed call-back numbers 226, 228, 230 (FIG. 2) and corresponding special alerts 236, 238, 240 (FIG. 2), as is described in detail herein below. Then, if the received call-back number matches one of the pre-programmed call-back numbers 226, 228, 230, the selective call receiver 110 generates one of the corresponding special alerts 136, 238, 240.

Referring to FIG. 2, an electrical block diagram of the selective call receiver 110 in accordance with the preferred embodiment of the present invention comprises an antenna 202 for intercepting the radio signals transmitted by the paging transmitter 108 (FIG. 1). The antenna 202 is coupled to a receiver 204 for demodulating the intercepted radio signals to derive address and message information comprising at least a call-back number. The receiver 204 is coupled to a decoder 206 for decoding the address information, and to a microprocessor 208 for processing the message information. The microprocessor 208 is coupled to an audible alert generator 212 for generating an audible alert in response to instructions from the processor after receipt of a message. The microprocessor 208 is also coupled to a display 214, such as a liquid crystal display, for displaying the received message. The microprocessor 208 is also coupled to user controls 216, such as well-known buttons and switches, for allowing a user to control operation of the selective call receiver 110.

In addition, the microprocessor 208 is coupled to an electrically erasable programmable read only memory (EEPROM) 210, a read only memory (ROM) 218, and a random access memory (RAM) 220 for storing pre-programmed values, operating firmware, and temporarily needed values, respectively. The EEPROM 210 comprises values for the pre-programmed call-back numbers 226, 228, 230 and the corresponding special alerts 236, 238, 240 comprising values for both alert cadence and alert tone frequency. Also included in the EEPROM 210 are alert cadence and alert tone frequency values for a default alert 242 associated with a default call-back number, i.e., a received call-back number that does not match any of the pre-programmed call-back numbers 226, 228, 230. In addition, the EEPROM 210 stores values for at least one pre-programmed selective call address 244 to which the selective call receiver is responsive.

The ROM 218 comprises Silent and Non-silent Alert Operation firmware 222 for controlling alerting of the selective call receiver 110 according to a silent or non-silent alert mode selected by the user. Also included is Alerts firmware 223 for controlling the audible alert generator 212 in accordance with the pre-programmed special alerts 236, 238, 240 and default alert 242. In addition, Add, Delete, and Default Modify firmware 225, 227, and 229 are provided for adding a new member of the pre-programmed call-back numbers 226, 228, 230 and corresponding special alerts 236, 238, 240, and for modifying the default alert 242. Also included is Match firmware 250 for comparing a received call-back number with the pre-programmed call-back numbers 226, 228, 230.

The RAM 220 is utilized by the microprocessor 208 for temporary storage of operational values, such as timer values, counters, received information, etc., in RAM locations in a manner well known in the art of stored program processing systems. One such location is an Alert Mode location 224 for storing the alert mode, i.e., silent or non-silent alert mode, last selected by the user. Another such location is a received call-back number location 233 for storing a received call-back number.

Referring to FIG. 3, an orthographic front view of the selective call receiver 110 in accordance with the preferred embodiment of the present invention depicts the display 214 as it would appear during a procedure for adding a new member to the pre-programmed call-back numbers 226, 228, 230 and corresponding special alerts 236, 238, 240 (FIG. 2). Also depicted are members of the user controls 216 (FIG. 2) comprising an ADD button 304 for adding a new member to the pre-programmed call-back numbers 226, 228, 230 and corresponding special alerts 236, 238, 240, and a DEL button 306 for deleting one of the pre-programmed call-back numbers 226, 228, 230 and corresponding special alerts 236, 238, 240. A DEF button 308 is for modifying the default alert 242 (FIG. 2), while an ALM button 310 is provided for toggling between silent and non-silent alert modes. Movement of a cursor 336 on the display 214 is controlled by an UP CURSOR button 312, a RIGHT CURSOR button 314, a DOWN CURSOR button 316, and a LEFT CURSOR button 318. In addition, there is a SELECT button 320 for selecting a displayed item, as described herein below, and a READ button 322 for reading a selected received message. Operation of the user controls 214 in accordance with the preferred embodiment of the present invention is more fully described herein below in the detailed description of FIGS. 5, 6, 7, and 8.

On the display 214 are a call-back number prompt 324 and an entered call-back number 326 entered by the user. A cadence prompt 328 is also on the display, followed by a cadence identifier 330 selected by the user. In addition, the display shows a tone frequency prompt 332 and a tone frequency identifier 334 selected by the user.

Figure 4:
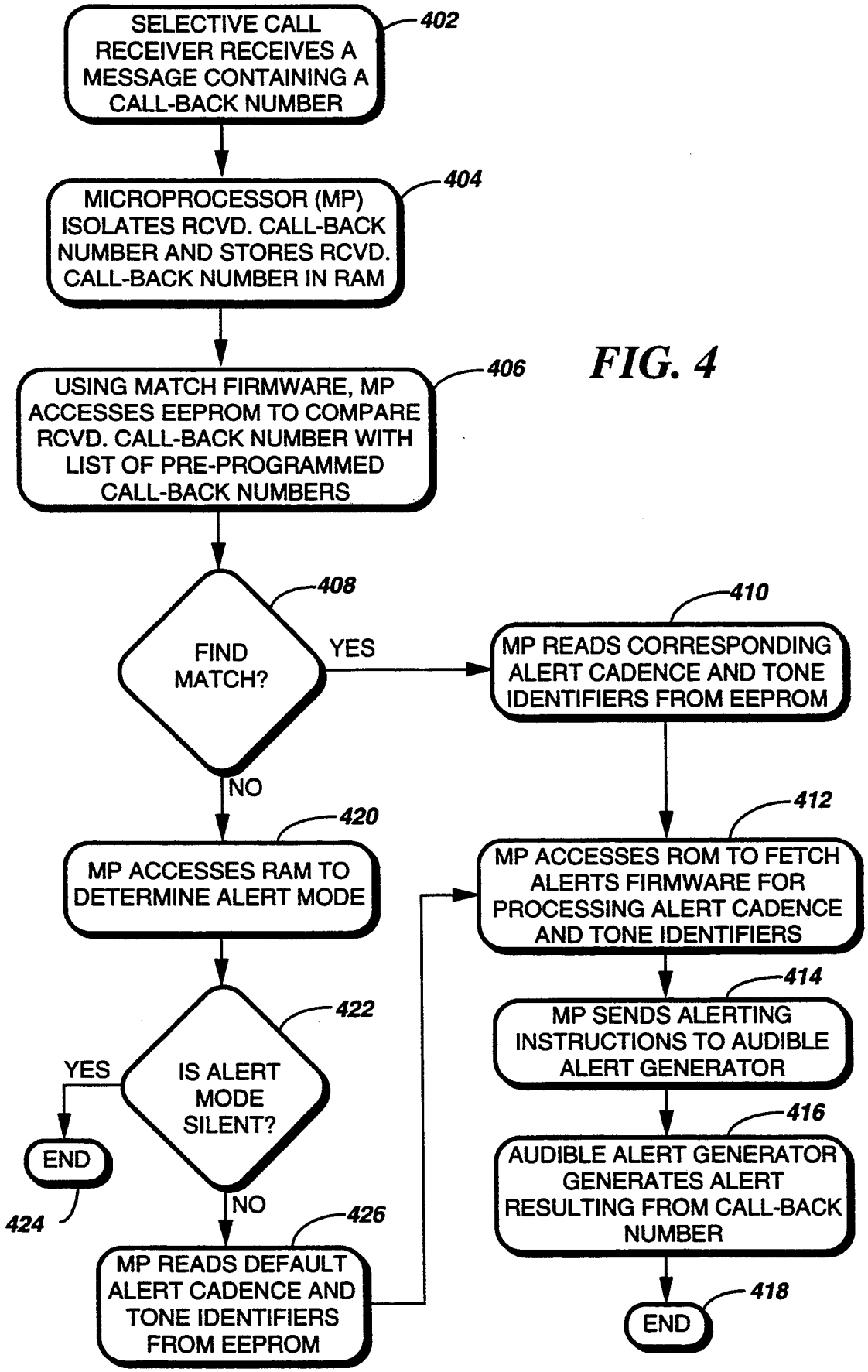
FIG. 4 is a flow chart of a method in the selective call receiver for alert control responsive to a received call-back number in accordance with the preferred embodiment of the present invention.

Referring to FIG. 4, a flow chart of a method in the selective call receiver 110 (FIG. 2) for alert control responsive to a received call-back number in accordance with the preferred embodiment of the present invention begins with the selective call receiver 110 receiving 402 a message containing a call-back number. The microprocessor 208 (FIG. 2) of the selective call receiver 110 isolates 404 the received call-back number and stores it temporarily in the received call-back number location 233 in the RAM 220 (FIG. 2). Next, using the Match firmware 250 (FIG. 2), the microprocessor 208 accesses 406 the EEPROM 210 (FIG. 2) to compare the received call-back number with the pre-programmed call-back numbers 226, 228, 230 to see if any of the pre-programmed call-back numbers 226, 228, 230 match the received call-back number. If in step 408 a match is found, then the microprocessor 208 reads 410 from the EEPROM 210 the corresponding one of the special alerts 236, 238, 240 (FIG. 2) comprising alert cadence and tone frequency identifiers. Using the Alerts firmware 223 (FIG. 2), the microprocessor 208 processes 412 the alert cadence and tone frequency identifiers to determine alerting instructions. Next, the microprocessor 208 sends 414 the alerting instructions to the audible alert generator 212 (FIG. 2). In response, the audible alert generator 212 generates 416 an alert corresponding to the one of the special alert 236, 238, 240 pre-programmed for the matched received call-back number, and the process ends 418. Programmable audible alert generators, such as the audible alert generator 212, are well known in the art. U.S. Pat. No. 4,868,561 issued Sep. 19, 1989 to Davis, which describes a programmable audible alert generator, is hereby incorporated by reference herein.

If, on the other hand, in step 408 the microprocessor 208 (FIG. 2) does not find a match to the received call-back number, then the microprocessor 208 accesses 420 the Alert Mode location 224 in the RAM 220 to determine the alert mode. If in step 422 the microprocessor 208 finds that the alert mode is silent, then the process ends 424. If in step 422 the microprocessor 208 finds that the alert mode is non-silent, then the microprocessor 208 reads 426 the default alert 242 (FIG. 2) from the EEPROM 210 and sends the cadence and tone frequency identifiers to step 412 as before, ultimately resulting in generation of an alert corresponding to the default alert 242.

Figure 5:
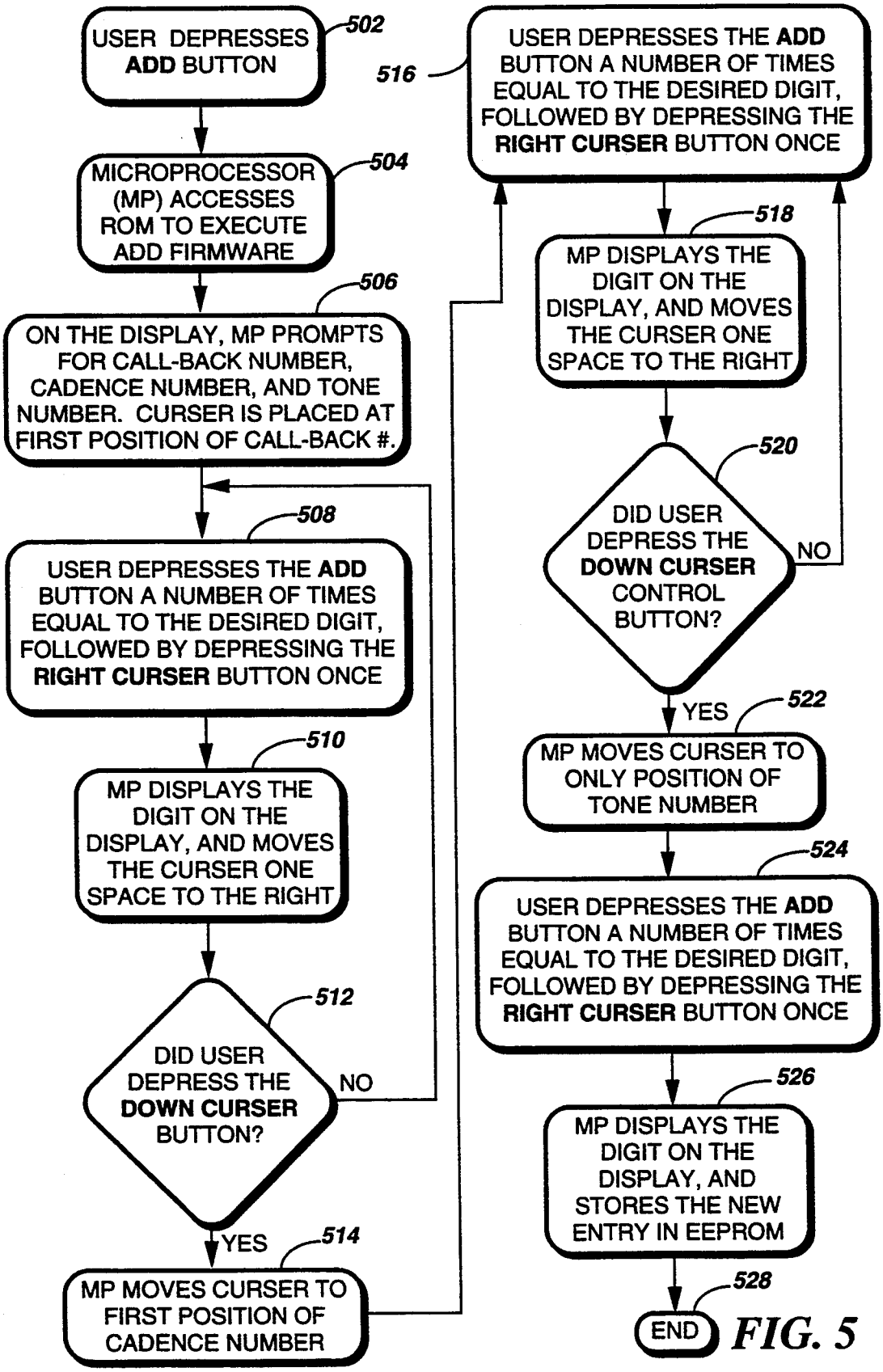
FIG. 5 is a flow chart of a method in the selective call receiver for adding a new call-back number and corresponding special alert in accordance with the preferred embodiment of the present invention.

Referring to FIG. 5, a flow chart of a method in the selective call receiver 110 (FIG. 2) for adding a new call-back number and corresponding special alert in accordance with the preferred embodiment of the present invention begins with a user depressing 502 the ADD button 304 (FIG. 3). In response, the microprocessor 208 (FIG. 2) accesses 504 the ROM 218 to execute the Add firmware 225 (FIG. 2). Next, the microprocessor 208 instructs 506 the display 214 (FIG. 3) to generate the call-back number prompt 324, the cadence prompt 328, and the tone frequency prompt 332 (FIG. 3), while placing the cursor 336 at a first position for entry of the new call-back number. To enter the first digit of the new call-back number, the user depresses 508 the ADD button 304 a number of times equal to the desired digit, e.g., no times for the digit zero or six times for the digit six, followed by depressing the RIGHT CURSOR button 314 (FIG. 3) once to move to the next digit. While not shown in the flow chart of FIG. 5, the user also may depress the DEL button 306 (FIG. 3) to reduce the value of a digit at the position of the cursor 336 by a count of one, e.g., to correct an overcount. Concurrent with the depression of the ADD (or DEL) button 304, 306 the microprocessor 208 displays 510 the resultant digit on the display 214, and after the depression of the RIGHT CURSOR button 314, moves the cursor 336 one position to the right. If in step 512 the user has not additionally depressed the DOWN CURSOR button 316 (FIG. 3), then flow returns to step 508 for entry of the next digit of the new call-back number.

If, on the other hand, in step 512 the user has depressed the DOWN CURSOR button 316 (FIG. 3), then the microprocessor 208 (FIG. 2) moves 514 the cursor 336 (FIG. 3) to a first position for entry of a cadence identifier number. As before, the user depresses 516 the ADD (or DEL) button 304, 306 (FIG. 3) a number of times to reach the desired digit, followed by depressing the RIGHT CURSOR button 314 (FIG. 3) to move to the next digit position. Also as before, concurrent with the depression of the ADD (or DEL) button 304, 306 the microprocessor 208 displays 518 the resultant digit on the display 214 (FIG. 3), and after the depression of the RIGHT CURSOR button 314, moves the cursor 336 one position to the right. If in step 520 the user has not additionally depressed the DOWN CURSOR button 316, then flow returns to step 516 for entry of the next digit of the cadence identifier number.

If, on the other hand, in step 520 the user has depressed the DOWN CURSOR button 316 (FIG. 3), then the microprocessor 208 (FIG. 2) moves 522 the cursor 336 (FIG. 3) to the single position for entry of a tone frequency identifier number. Next, the user depresses 524 the ADD (or DEL) button 304, 306 (FIG. 3) a number of times to reach the desired digit, followed by depressing the RIGHT CURSOR button 314 (FIG. 3) once. In response, the microprocessor 208 displays 526 the digit on the display 214 (FIG. 3) and stores the new call-back number and corresponding special alert along with the other pre-programmed call-back numbers 226, 228, 230 and corresponding special alerts 236, 238, 240 in the EEPROM 210 (FIG. 2). At step 528, the process ends.

Figure 6:
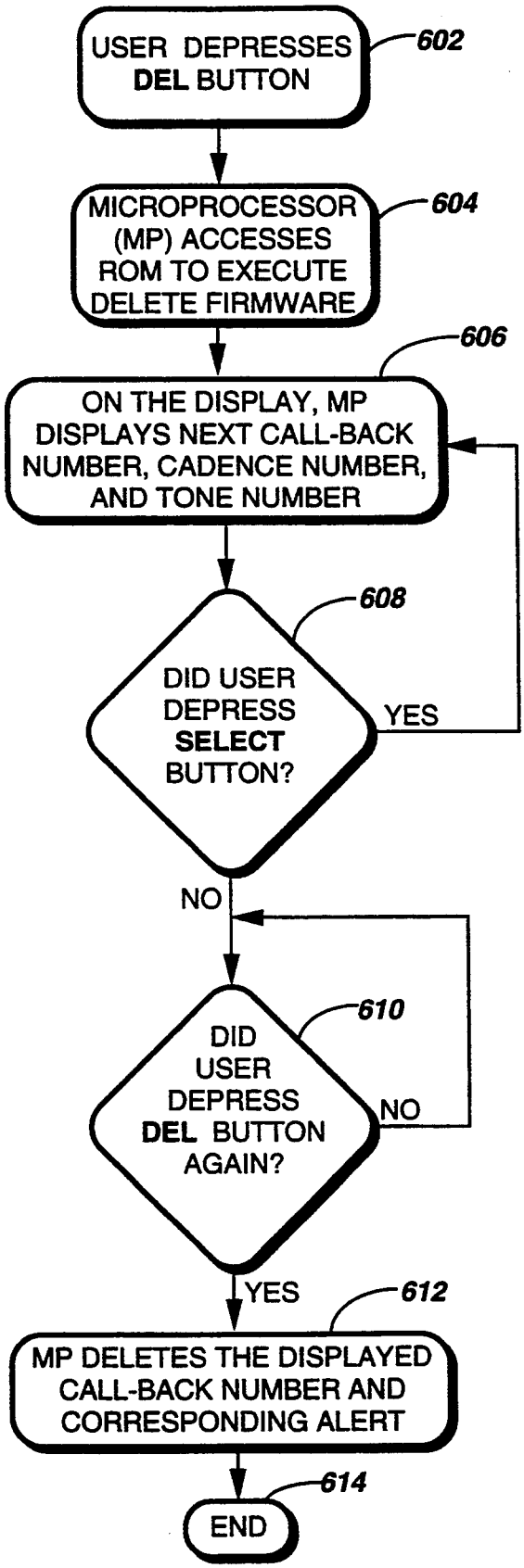
FIG. 6 is a flow chart of a method in the selective call receiver for deleting a call-back number and corresponding special alert in accordance with the preferred embodiment of the present invention.

Referring to FIG. 6, a flow chart of a method in the selective call receiver 110 (FIG. 2) for deleting one of the call-back numbers 226, 228, 230 (FIG. 2) and corresponding special alerts 236, 238, 240 (FIG. 2) in accordance with the preferred embodiment of the present invention begins with the user depressing the DEL button 306 (FIG. 3). In response, the microprocessor 208 (FIG. 2) accesses 604 the ROE 218 to execute the Delete firmware 227. On the display 214 (FIG. 3) the microprocessor 208 displays 606 the first one of the pre-programmed call-back numbers 226, 228, 230, along with an alert descriptor of the corresponding one of the special alerts 236, 238, 240, the alert descriptor comprising a cadence identifier number and a tone frequency identifier number. If in step 608 the user depresses the SELECT button 320 (FIG. 3), then the flow returns to step 606 to display the next one of the pre-programmed call-back numbers 226, 228, 230 and corresponding alert descriptor, and so on, until the user finds one of the call-back numbers 226, 228, 230 that the user desires to delete. When in step 608 the user has not depressed the SELECT button 320, but instead has again pressed the DEL button 306, then from step 610 flow advances to step 612, where the microprocessor 208 deletes the currently displayed one of the call-back numbers 226, 228, 230 and corresponding one of the special alerts 236, 238, 240, after which the process ends 614.

Figure 7:
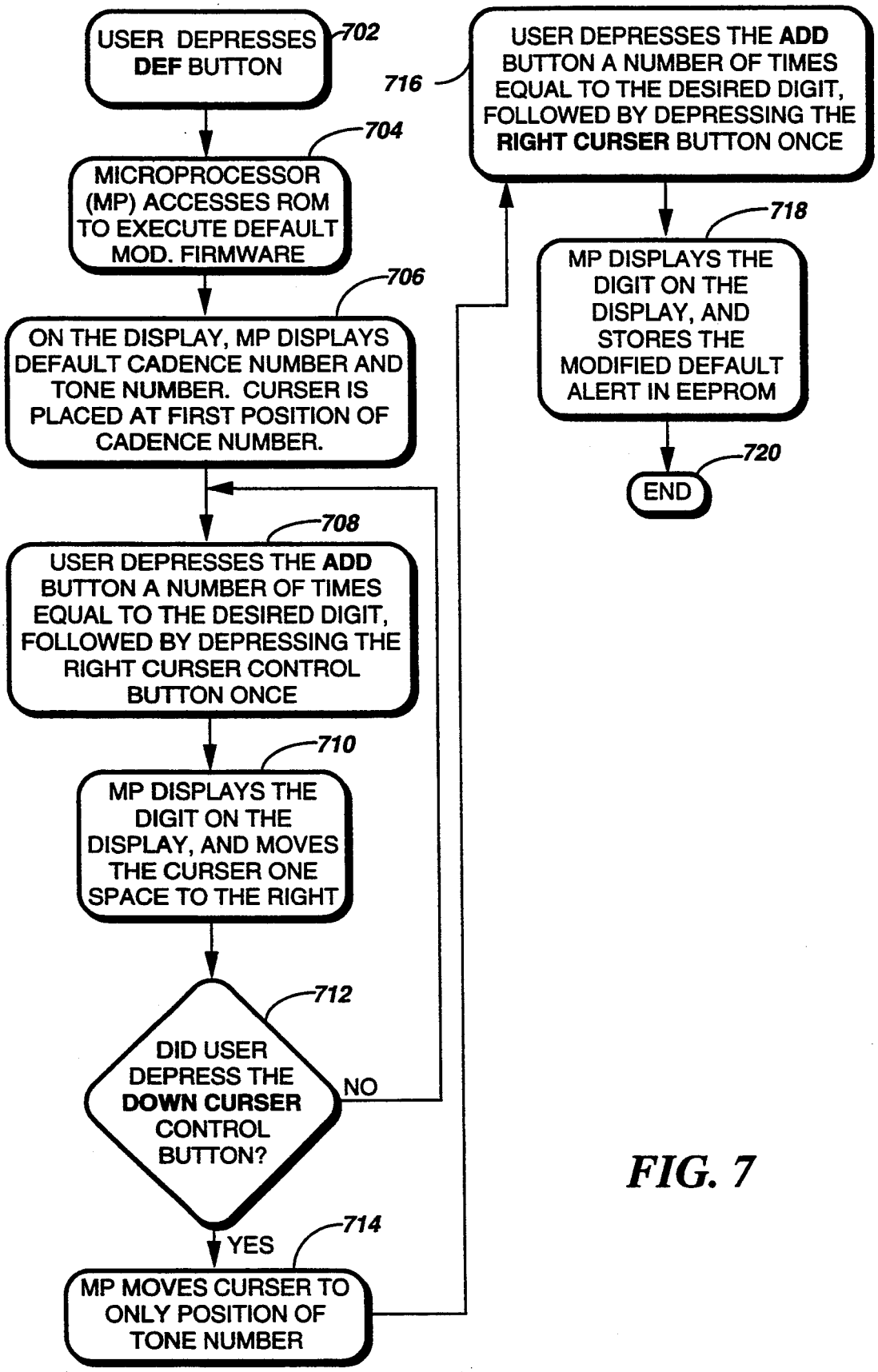
FIG. 7 is a flow chart of a method in the selective call receiver for modifying a default alert in accordance with the preferred embodiment of the present invention.

Referring to FIG. 7, a flow chart of a method in the selective call receiver 110 (FIG. 2) for modifying the default alert 242 (FIG. 2) in accordance with the preferred embodiment of the present invention begins with the user depressing 702 the DEF button 308 (FIG. 3). In response, the microprocessor 208 (FIG. 2) accesses 704 the ROM 218 (FIG. 2) to execute the Default Modify firmware 229 (FIG. 2). On the display 214 (FIG. 3) the microprocessor 208 displays 706 the currently programmed default cadence identifier number and default tone frequency identifier number. The cursor 336 (FIG. 3) is placed at the first position for entry of the cadence identifier number. As before, the user depresses 708 the ADD (or DEL) button 304, 306 (FIG. 3) a number of times to reach the desired digit, followed by depressing the RIGHT CURSOR button 314 (FIG. 3) to move to the next digit position. If the user does not wish to change a displayed digit at the cursor position, the user may depress the RIGHT CURSOR button 314 without depressing the ADD (or DEL) button 304, 306. Also as before, concurrent with the depression of the ADD (or DEL) button 304, 306 (FIG. 3) the microprocessor 208 displays 710 the resultant digit on the display 214 (FIG. 3), and after the depression of the RIGHT CURSOR button 314, moves the cursor 336 one position to the right. If in step 712 the user has not additionally depressed the DOWN CURSOR button 316 (FIG. 3), then flow returns to step 708 for entry of the next digit of the cadence identifier number.

If, on the other hand, in step 712 the user has depressed the DOWN CURSOR button 316 (FIG. 3), then the microprocessor 208 (FIG. 2) moves 714 the cursor 336 (FIG. 3) to the single position for entry of a tone frequency identifier number. Next, the user depresses 716 the ADD (or DEL) button 304, 306 (FIG. 3) a number of times to reach the desired digit, followed by depressing the RIGHT CURSOR button 314 (FIG. 3) once. If the user does not wish to change the displayed digit at the cursor position, the user may depress the RIGHT CURSOR button 314 without depressing the ADD (or DEL) button 304, 306. In response, the microprocessor 208 displays 718 the digit on the display 214 (FIG. 3) and writes the newly entered values into the location in the EEPROM 210 (FIG. 2) for the modified default alert 242 (FIG. 2), after which the process ends 720.

Figure 8:
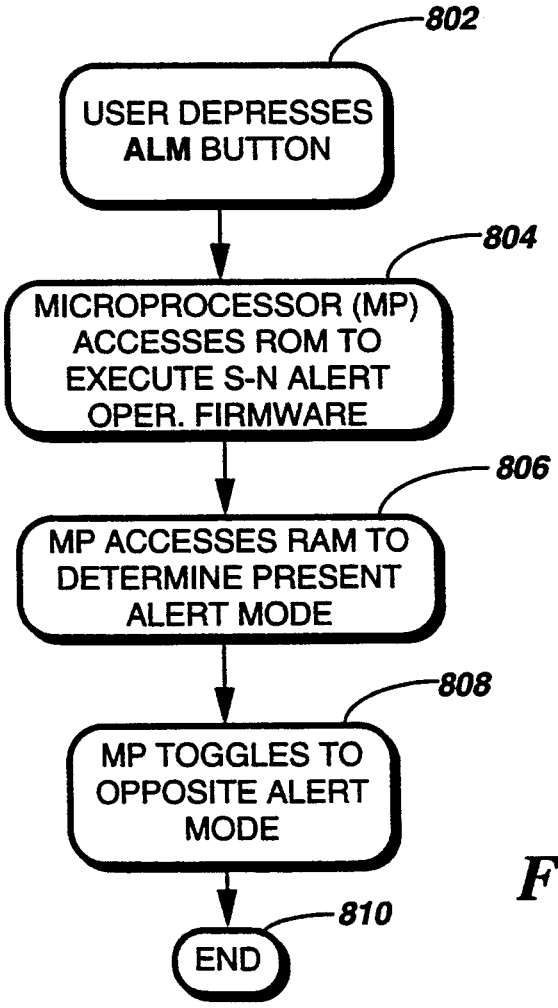
FIG. 8 is a flow chart of a method in the selective call receiver for toggling an alert mode in accordance with the preferred embodiment of the present invention.

Referring to FIG. 8, a flow chart of a method in the selective call receiver 110 (FIG. 2) for toggling the alert mode 224 (FIG. 2) in accordance with the preferred embodiment of the present invention begins with the user depressing 802 the ALM button 310 (FIG. 3). In response, the microprocessor 208 (FIG. 2) accesses the ROM 218 (FIG. 2) to execute the Silent and Non-silent Alert Operation firmware 222 (FIG. 2). Next, the microprocessor 208 accesses 806 the Alert Mode location 224 in the RAM 220 (FIG. 2) to determine the current alert mode, and then toggles 808 the alert mode to the mode opposite the current mode, e.g., to the silent alert mode if the current alert mode is non-silent, and vice versa, after which the process ends 810.

It will be appreciated that different user controls and different user control operation may be substituted for the user controls and user control operation described herein above for the preferred embodiment without departing from the intent of the present invention. For example, a displayed menu and a cursor could be used instead of direct buttons to access functions such as Add, Delete, etc., in a manner well known in the art. For another example, a full numeric keypad could be used to enter information such as call-back number, cadence number, etc., instead of multiple depressions of a single button to count up or down to a digit value.

Thus, the present invention provides a way of helping a user discern that a call is from a predetermined important caller or group of important callers without the user's having to memorize call-back numbers or having to read a poorly lighted displayed number. The present invention advantageously enables the user to pre-program a selective call receiver such that the selective call receiver generates a recognizable, unique, audible alert in response to receiving a call-back number that the user considers important. The present invention advantageously eliminates the need to use expensive multiple telephone access numbers for a single pager in order to provide audibly distinct alerts.

We claim:

1. A communication receiver comprising:

receiver means for receiving a message comprising at least a received call-back number;

storage means for storing at least one user-programmed call-back number along with data defining at least one corresponding user-programmed special audible alert, and further for storing data defining a user-programmed default audible alert;

processor means coupled to the receiver means for processing the message to derive the received call-back number and coupled to the storage means for comparing the received call-back number with the at least one user-programmed call-back number; and audible alert generation means coupled to the processor means for generating, in response to the received call-back number being found equal to a call-back number included in the at least one user-programmed call-back number, the corresponding user-programmed special audible alert in accordance with the data defining said alert, wherein the processor means comprises a first processor element for controlling the audible alert generation means to generate the user-programmed default audible alert in response to the received call-back number being found not equal to any call-back number included in the at least one user-programmed call back number.

2. The communication receiver in accordance with claim 1, further comprising user control means coupled to the processor means and to the storage means for allowing a user to add or delete a user-programmed call-back number and a corresponding user-programmed special audible alert.

3. The communication receiver in accordance with claim 1, wherein the storage means comprises a non-volatile memory.

4. The communication receiver in accordance with claim 1, further comprising user control means coupled to the processor means for allowing a user to modify the user-programmed default audible alert.

5. The communication receiver in accordance with claim 4, further comprising a second processor element coupled to the processor means and responsive to the user control means for controlling the generation of the user-programmed default audible alert, wherein the second processor element disallows generation of the user-programmed default audible alert but allows generation of the user-programmed special audible alert in response to user selection of a first alert mode, and wherein the second processor element allows generation of both the user-programmed default audible alert and the user-programmed special audible alert in response to user selection of a second alert mode.

6. The communication receiver in accordance with claim 2, wherein the user control means comprises:

means for a user to select a cadence for a new user-programmed special audible alert; and means for a user to select a tone frequency for the new user-programmed special audible alert, and wherein the audible alert generation means generates the new user-programmed special audible alert in accordance with the selected cadence and tone frequency.

7. The communication receiver in accordance with claim 4, wherein the user control means comprises:

means for a user to select a cadence for the user-programmed default audible alert; and means for a user to select a tone frequency for the user-programmed default audible alert, and wherein the audible alert generation means generates the user-programmed default audible alert in accordance with the selected cadence and tone frequency.

8. (Amended) A selective call receiver comprising:

a receiver for receiving information comprising an address and a message containing at least a received call-back number;

a decoder coupled to the receiver for decoding the received address;

a memory element for storing at least one user-programmed call-back number and data defining at least one corresponding user-programmed special audible alert, and further for storing data defining a user-programmed default audible alert;

a processor responsive to the decoder and coupled to the receiver for processing the received message to derive the received call-back number, the processor also coupled to the memory element for comparing the received call-back number with the at least one user-programmed call-back number;

a display coupled to the processor for displaying the received message; and an audible alert generator coupled to the processor for generating, in response to the received call-back number being found equal to a call-back number included in the at least one user-programmed call-back number, the corresponding user-programmed special audible alert in accordance with the data defining said alert, wherein the processor comprises a first processor element for controlling the audible alert generator to generate the user-programmed default audible alert in response to the received call-back number being found not equal to any call-back number included in the at least one user-programmed call back number.

9. The selective call receiver in accordance with claim 8, further comprising user controls coupled to the processor and to the memory element for allowing a user to add or delete a user-programmed call-back number and a corresponding user-programmed special audible alert.

10. The selective call receiver in accordance with claim 8, wherein the memory element comprises a non-volatile memory.

11. The selective call receiver in accordance with claim 8, further comprising user controls coupled to the processor for allowing a user to modify the user-programmed default audible alert.

12. The selective call receiver in accordance with claim 11, further comprising a second processor element coupled to the processor and responsive to the user controls for controlling the generation of the user-programmed default audible alert, wherein the second processor element disallows generation of the user-programmed default audible alert but allows generation of the user-programmed special audible alert in response to user selection of a first alert mode, and wherein the second processor element allows generation of both the user-programmed default audible alert and the user-programmed special audible alert in response to user selection of a second alert mode.

13. The selective call receiver in accordance with claim 9, wherein the user controls comprise:

first elements that allow a user to select a cadence for a new user-programmed special audible alert; and second elements that allow a user to select a tone frequency for the new user-programmed special audible alert, and wherein the audible alert generator generates the new user-programmed special audible alert in accordance with the selected cadence and tone frequency.

14. The selective call receiver in accordance with claim 11, wherein the user controls comprise:

first elements that allow a user to select a cadence for the user-programmed default audible alert; and second elements that allow a user to select a tone frequency for the user-programmed default audible alert, and wherein the audible alert generator generates the user-programmed default audible alert in accordance with the selected cadence and tone frequency.

15. A method in a communication receiver for controlling an audible alert in response to a received call-back number, the method comprising the steps of:

(a) receiving a message comprising at least the received call-back number;

(b) comparing the received call-back number with at least one user-programmed call-back number;

(c) selecting a user-programmed special audible alert corresponding to the received call-back number in response to determining in step (b) that the received call-back number is equal to a call-back number included in the at least one user-programmed call-back number;

(d) selecting a user-programmed default audible alert in response to determining in step (b) that the received call-back number is not equal to any call-back number included in the at least one user-programmed call-back number; and (e) generating the user-programmed audible alert selected in accordance with steps (c) and (d).

16. The method in accordance with claim 15, further comprising the step of adding a new user-programmed call-back number and a corresponding new user-programmed special audible alert in response to a user control sequence.

17. The method in accordance with claim 15, further comprising the step of deleting an existing user-programmed call-back number and a corresponding user-programmed special audible alert in response to a user control sequence.

18. The method in accordance with claim 15, further comprising the step of modifying the user-programmed default audible alert in response to a user control sequence.

19. The method in accordance with claim 15, wherein step (d) further comprises the step of de-selecting the user-programmed default audible alert to prevent the generation thereof, a user of the communication receiver having selected a silent alert mode.

20. The method in accordance with claim 16, wherein the step of adding the new user-programmed call-back number and the corresponding new user-programmed special audible alert comprises the steps of:

selecting a user-programmable cadence for the new user-programmed special audible alert; and selecting a user-programmable tone frequency for the new user-programmed special audible alert, and wherein the new user-programmed special audible alert is generated in accordance with the selected cadence and tone frequency.

* * * * *

UNITED STATES PATENT AND TRADEMARK OFFICE

CERTIFICATE OF CORRECTION

PATENT NO. : 5,394,140

DATED : February 28, 1995

INVENTOR(S) : Wong et al.

It is certified that error appears in the above-indentified patent and that said Letters Patent is hereby corrected as shown below:

Column 10, line 9, please delete "(Amended)".

Signed and Sealed this

Twelfth Day of September, 1995

Bruce Lehman

*Attest:*

BRUCE LEHMAN

*Attesting Officer*

*Commissioner of Patents and Trademarks*

US005394140C1

(12) EX PARTE REEXAMINATION CERTIFICATE (10324th)

United States Patent
Wong et al.

(10) Number: US 5,394,140 C1
(45) Certificate Issued: Oct. 14, 2014

(54) METHOD AND APPARATUS FOR PRE-PROGRAMMED CALL-BACK-NUMBER-DETERMINED ALERT

(75) Inventors: Poh-T'in Wong, Boynton Beach, FL (US); Allen J. Weidler, Lake Worth, FL (US); William J. Burke, Boca Raton, FL (US)

(73) Assignee: Motorola, Inc., Schaumburg, IL (US)

Reexamination Request:
No. 90/010,278, Sep. 16, 2008

Reexamination Certificate for:

| | |
|---|---|
| Patent No.: | **5,394,140** |
| Issued: | **Feb. 28, 1995** |
| Appl. No.: | **07/980,047** |
| Filed: | **Nov. 23, 1992** |

Certificate of Correction issued Sep. 12, 1995

(51) Int. Cl.
*G08B 5/22* (2006.01)

(52) U.S. Cl.
USPC ..... 340/7.39; 340/7.62; 379/210.01

(58) Field of Classification Search
None
See application file for complete search history.

(56) References Cited

To view the complete listing of prior art documents cited during the proceeding for Reexamination Control Number 90/010,278, please refer to the USPTO's public Patent Application Information Retrieval (PAIR) system under the Display References tab.

*Primary Examiner* — Michelle Tarae

(57) ABSTRACT

A method and apparatus in a communication receiver (110) for controlling an alert in response to a received call-back number (233) include receiving (402) the call-back number (233). A processor (208) in the communication receiver (110) compares (406) the received call-back number (233) with a list of pre-programmed call-back numbers (226, 228, 230) stored in a memory (210). If the received call-back number (233) matches (408) one of the pre-programmed call-back numbers (226, 228, 230), the processor (208) selects (410) a pre-programmed alert (236, 238, 240) corresponding to the matched pre-programmed call-back number (233), and instructs (414) an alert generator (212) to generate the selected pre-programmed alert (236, 238, 240).

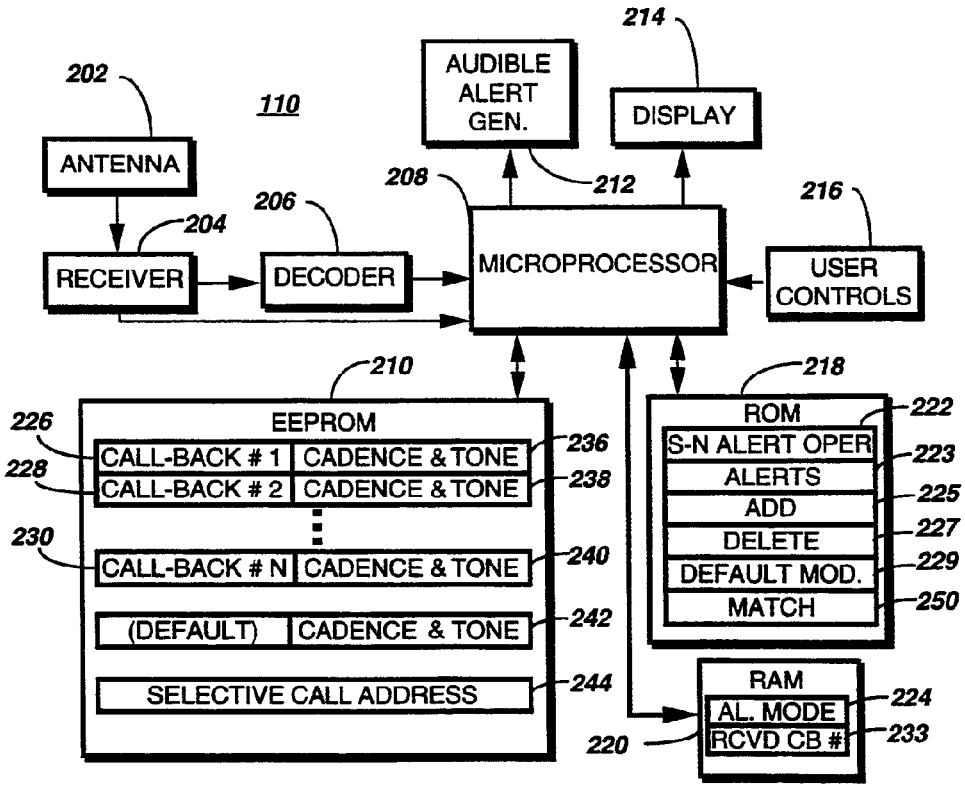

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 6, 7, 13, 14 and 20 is confirmed.

Claims 1-5, 8-12 and 15-19 are cancelled.

* * * * *